US008971737B2

(12) United States Patent
Hayashi et al.

(10) Patent No.: US 8,971,737 B2
(45) Date of Patent: Mar. 3, 2015

(54) IMAGE FORMING APPARATUS

(71) Applicant: Kyocera Document Solutions Inc., Osaka (JP)

(72) Inventors: Nobuyuki Hayashi, Osaka (JP); Koichi Hayashi, Osaka (JP); Shigeki Tsukahara, Osaka (JP); Takahiko Murata, Osaka (JP); Ai Takagami, Osaka (JP); Yosuke Saito, Osaka (JP); Maki Ike, Osaka (JP); Masaki Kadota, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/188,420

(22) Filed: Feb. 24, 2014

(65) Prior Publication Data

US 2014/0294410 A1 Oct. 2, 2014

(30) Foreign Application Priority Data

Mar. 26, 2013 (JP) ..... 2013-064482
Mar. 26, 2013 (JP) ..... 2013-064487

(51) Int. Cl.
*G03G 15/00* (2006.01)
*G03G 21/20* (2006.01)
*G03G 15/16* (2006.01)

(52) U.S. Cl.
CPC ..... *G03G 21/203* (2013.01); *G03G 15/161* (2013.01); *G03G 2215/0132* (2013.01)
USPC ..... 399/44; 399/50

(58) Field of Classification Search
USPC ..... 399/38, 44, 46, 50, 107, 110, 115
See application file for complete search history.

(56) References Cited

U.S. PATENT DOCUMENTS

2006/0088325 A1* 4/2006 Suzuki ..... 399/44

FOREIGN PATENT DOCUMENTS

JP 2007-94354 A 4/2007
JP 2012-141541 A 7/2012

* cited by examiner

*Primary Examiner* — Hoan Tran
(74) *Attorney, Agent, or Firm* — Stein IP, LLC

(57) ABSTRACT

An image forming apparatus includes an image bearing member, a first conductive member, a bias application device, and a control portion, and performs image formation on a surface of the image bearing member while making the image bearing member rotate. The image forming apparatus is capable of executing a heating-up mode in which, at the time of non-image formation, in a state where the image bearing member is made to rotate at a velocity lower than that used at the time of image formation, an alternating current bias having a frequency higher than that used at the time of image formation and a peak-to-peak value twice or more as large as a discharge start voltage between the first conductive member and the image bearing member is applied to the first conductive member to cause a surface of the image bearing member to be heated up.

12 Claims, 7 Drawing Sheets

IMAGE FORMING APPARATUS

CROSS-REFERENCE TO RELATED APPLICATIONS

This application is based on and claims the benefit of Japanese Patent Application No. 2013-64482, filed on Mar. 26, 2013 and Japanese Patent Application No. 2013-64487 filed on Mar. 26, 2013, the contents of which are hereby incorporated by reference.

BACKGROUND OF THE INVENTION

The present disclosure relates to an image forming apparatus using a photosensitive drum, and relates particularly to a method for removing moisture on a surface of the photosensitive drum.

In an image forming apparatus using an electrophotographic method, such as a copy machine, a printer, or a facsimile, a developing agent in powder form (hereinafter, referred to as toner) is mainly used, and, typically, a process is performed in which an electrostatic latent image formed on an image bearing member such as a photosensitive drum is visualized by using the toner in a developing device, and a toner image thus formed is transferred onto a recording medium and then subjected to fixing processing. A photosensitive drum is formed of a cylindrical base member and a photosensitive layer of tens to several tens of μm in thickness formed on a surface of the cylindrical base member. In terms of a main material constituting the photosensitive layer, photosensitive drums can be classified into an organic photosensitive member, a selenium arsenic photosensitive member, an amorphous silicon (hereinafter, abbreviated as a-Si) photosensitive member, and so on.

The organic photosensitive member, though being relatively low-cost, is susceptible to wear and thus requires frequent replacement thereof. Furthermore, the selenium arsenic photosensitive member, though having a long life compared with the organic photosensitive member, is, disadvantageously, a toxic substance and thus is difficult to handle. On the other hand, the a-Si photosensitive member, though being costly compared with the organic photosensitive member, is a harmless substance and thus is easy to handle. In addition, the a-Si photosensitive member has a high hardness and thus has excellent durability (which is five or more times greater than that of the organic photosensitive member), and characteristics thereof as a photosensitive member are hardly degraded even after long-term use, so that a high image quality can be maintained. The a-Si photosensitive member thus makes an excellent image bearing member whose running cost is low and that achieves a high level of environmental safety.

As is known, in an image forming apparatus using a photosensitive drum of any of the above-described types, due to characteristics thereof, depending on conditions of use, so-called image deletion is likely to occur, i.e. a faded image or an image smeared at a periphery thereof is likely to be formed. A factor responsible for the occurrence of image deletion is as follows. That is, when a surface of the photosensitive drum is charged by using a charging device, ozone is generated due to electrical discharge by the charging device. By the ozone thus generated, components contained in the air are decomposed to generate ion products such as $NO_x$ and $SO_x$. Being soluble in water, these ion products adhere to the photosensitive drum and penetrate into an about 0.1 μm-thick roughness structure of the surface of the photosensitive drum. This makes it impossible for the ion products to be removed by using a cleaning system used in a general-purpose apparatus, and they take in moisture in the atmospheric air, which leads to a decrease in resistance of the surface of the photosensitive drum. Because of this, a lateral flow of potential occurs at an edge portion of an electrostatic latent image formed on the surface of the photosensitive drum, which may result in the occurrence of image deletion. This phenomenon is pronounced particularly in a case of the a-Si photosensitive member, which hardly suffers from surface wear caused by a blade or the like and whose surface has a molecular structure likely to absorb moisture.

Various methods for preventing the occurrence of such image deletion have conventionally been proposed. For example, a method is known in which a heat generating member (heater) is provided inside a photosensitive drum or inside a rubbing member being in contact with the photosensitive drum, and controlled, based on a temperature and a humidity detected by a temperature and humidity sensor in an apparatus, to perform heating to evaporate moisture adhering to a surface of the photosensitive drum, so that the occurrence of image deletion is prevented.

The method in which the heater is disposed inside the photosensitive drum, however, requires that a slider electrode be used to connect the heater to a power source. Due to the presence of this sliding portion that connects the heater to the power source, as a total length of time of rotation of the photosensitive drum increases, a contact fault occurs at the sliding portion, which has been disadvantageous. Furthermore, in these days when there is a growing need for measures directed toward energy saving and environmental protection, it is strongly demanded that power consumption at the time of standby and at the time of normal printing be reduced. Particularly an image forming apparatus of a type having a plurality of drum units, such as a tandem-type full-color image forming apparatus, is large in power consumption, and hence it is not desirable to incorporate a heater therein. Other methods include a method in which heat around a cassette heater or a fixing device is transmitted to a vicinity of a photosensitive drum. This method, however, is not efficient in that a developer and so on in the vicinity also are undesirably heated.

As a solution to the above, an image forming apparatus is known that sets a weak charging period in which a charging voltage formed only of a direct current voltage or a charging voltage obtained by superimposing an alternating current voltage lower than that used at the time of image formation on a direct current voltage is applied, to a prescribed period before a start or after completion of a regular charging period or between a plurality of regular charging periods, thereby suppressing the generation of by-products of electrical discharge caused by application of a charging bias at a time other than the time of image formation.

Furthermore, an image forming apparatus is known that is capable of executing a moisture removing mode of performing, in order, a first moisture removing step in which, by using a cleaning blade, moisture is removed from a surface of a photosensitive drum, a second moisture removing step in which toner on a developing roller is conveyed toward the photosensitive drum and used to absorb moisture on the surface of the photosensitive drum, and the moisture is removed together with the toner, and a third moisture removing step in which moisture on a charging roller and on the surface of the photosensitive drum is removed by application of a voltage to the charging roller.

SUMMARY OF THE INVENTION

The present disclosure has as its object to provide an image forming apparatus that is capable of removing, with high efficiency, moisture on a surface of an image bearing member before a start of a printing operation.

An image forming apparatus according to a first aspect of the present disclosure includes an image bearing member, a first conductive member, a bias application device, and a control portion, and performs image formation on a surface of the image bearing member while making the image bearing member rotate. The image bearing member has a photosensitive layer formed on an outer peripheral surface thereof. The first conductive member makes contact with the photosensitive layer of the image bearing member. The bias application device applies a bias including an alternating current bias to the first conductive member. The control portion controls the bias application device. The image forming apparatus is capable of executing a heating-up mode in which, at the time of non-image formation, in a state where the image bearing member is made to rotate at a velocity lower than that used at the time of image formation, an alternating current bias having a frequency higher than that used at the time of image formation and a peak-to-peak value twice or more as large as a discharge start voltage between the first conductive member and the image bearing member is applied to the first conductive member to cause a surface of the image bearing member to be heated up.

Still other objects of the present disclosure and specific advantages provided by the present disclosure will be made further apparent from the following descriptions of embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
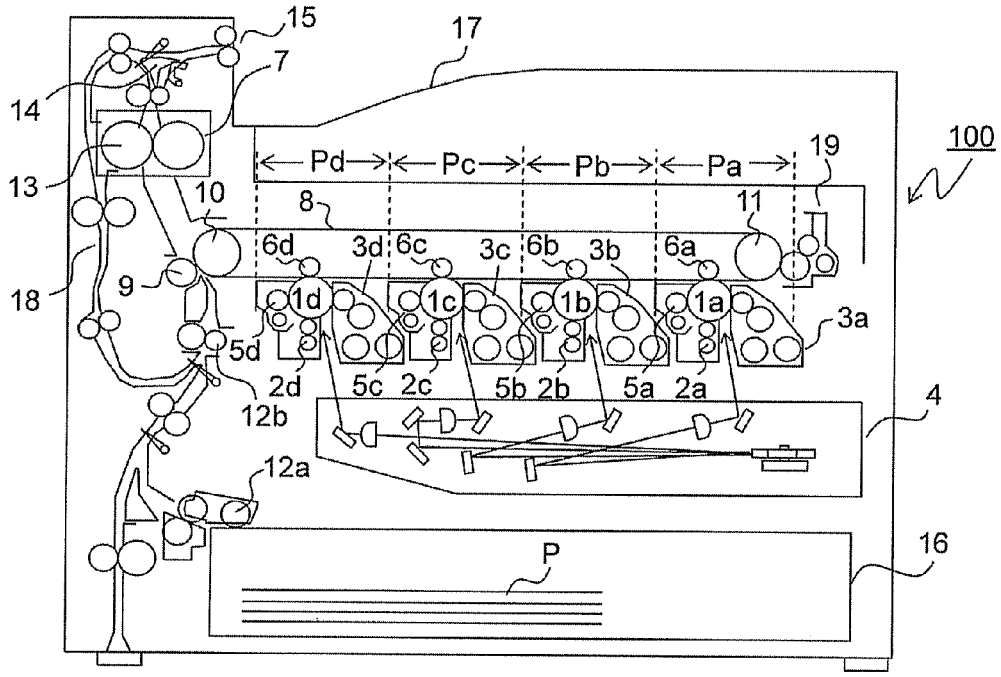
FIG. 1 is a schematic sectional view showing an overall configuration of a color printer 100 according to a first embodiment of the present disclosure.

With reference to the appended drawings, the following describes an embodiment of the present disclosure. FIG. 1 is a schematic view showing a configuration of a color printer 100 according to a first embodiment of the present disclosure. In a main body of the color printer 100, four image forming portions Pa, Pb, Pc, and Pd are arranged in order from an upstream side in a conveying direction (a right side in FIG. 1). The image forming portions Pa to Pd are provided so as to correspond to images of four different colors (cyan, magenta, yellow, and black) and form, in order, images of cyan, magenta, yellow, and black, respectively, through steps of charging, exposure, developing, and transfer.

In the image forming portions Pa to Pd, photosensitive drums 1*a*, 1*b*, 1*c*, and 1*d* to bear thereon visualized images (toner images) of the respective colors are arranged, respectively, and, herein, as each of the photosensitive drums 1*a*, 1*b*, 1*c*, and 1*d*, an a-Si photosensitive member formed of an aluminum drum and an a-Si photosensitive layer formed on an outer peripheral surface of the aluminum drum is used. Moreover, an intermediate transfer belt 8 that is driven by a driver (not shown) to rotate in a clockwise direction in FIG. 1 is provided adjacently to the image forming portions Pa to Pd. The toner images formed on the photosensitive drums 1*a* to 1*d*, respectively, are primarily transferred in order onto the intermediate transfer belt 8 moving while being in contact with the photosensitive drums 1*a* to 1*d* so as to be superimposed on each other. Thereafter, by an action of a secondary transfer roller 9, the toner images are secondarily transferred onto a sheet of transfer paper P as one example of a recording medium and fixed, at a fixing portion 7, onto the sheet of transfer paper P, which then is ejected from the apparatus main body. An image forming process with respect to each of the photosensitive drums 1*a* to 1*d* is executed while the photosensitive drums 1*a* to 1*d* are made to rotate in, for example, a counterclockwise direction in FIG. 1.

The transfer paper P onto which toner images are to be transferred is housed in a paper sheet cassette 16 at a lower portion in the apparatus, and is conveyed to the secondary transfer roller 9 via a paper feeding roller 12*a* and a registration roller pair 12*b*. As the intermediate transfer belt 8, a non-seamed (seamless) belt made of a dielectric resin sheet is mainly used. Furthermore, on an upstream side in a rotation direction of the intermediate transfer belt 8 with respect to the photosensitive drum 1*a*, a belt cleaning unit 19 is disposed that faces a tension roller 11 with the intermediate transfer belt 8 interposed therebetween.

The description is directed next to the image forming portions Pa to Pd. Around and below the photosensitive drums 1*a* to 1*d*, which are rotatably arranged, there are provided charging devices 2*a*, 2*b*, 2*c*, and 2*d* that charge the photosensitive drums 1*a* to 1*d*, respectively, an exposure unit 4 that exposes image information onto the photosensitive drums 1*a* to 1*d*, developing devices 3*a*, 3*b*, 3*c*, and 3*d* that form toner images on the photosensitive drums 1*a* to 1*d*, respectively, and cleaning devices 5*a* to 5*d* that remove a developing agent (toner) remaining on the photosensitive drums 1*a* to 1*d*, respectively.

Figure 2:
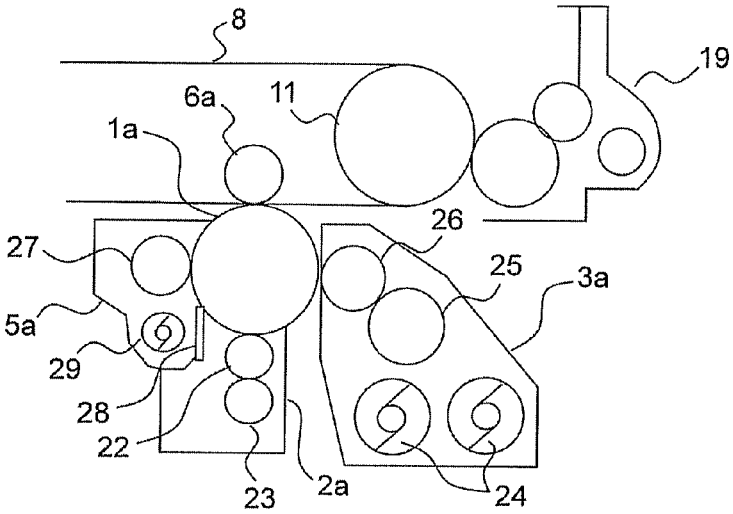
FIG. 2 is a partially enlarged view of a vicinity of an image forming portion Pa shown in FIG. 1.

With reference to FIG. 2, the following describes in detail the image forming portion Pa, while omitting descriptions of the image forming portions Pb to Pd whose configurations are basically similar to that of the image forming portion Pa. As shown in FIG. 2, around the photosensitive drum 1*a*, the charging device 2*a*, the developing device 3*a*, and the cleaning device 5*a* are arranged along a drum rotation direction (the counterclockwise direction in FIG. 1), and a primary transfer roller 6*a* is disposed with the intermediate transfer belt 8 interposed between the primary transfer roller 6*a* and the photosensitive drum 1*a*.

The charging device 2*a* has a charging roller 22 that makes contact with the photosensitive drum 1*a* and applies a charging bias to a drum surface thereof and a charging cleaning roller 23 for cleaning the charging roller 22. The charging roller 22 is configured by forming a roller body made of a conductive material such as an epichlorohydrin rubber on an outer peripheral surface of a metallic shaft.

The developing device 3*a* has two stirring and conveying screws 24, a magnetic roller 25, and a developing roller 26, and applies a developing bias having the same polarity (positive polarity) as that of toner to the developing roller 26 to cause the toner to fly onto the drum surface.

The cleaning device 5*a* has a cleaning roller 27, a cleaning blade 28, and a collection screw 29. The cleaning roller 27 is provided in press-contact with the photosensitive drum 1*a* under a prescribed pressure and is driven by an unshown driver to rotate in the same direction, at a contact surface with the photosensitive drum 1*a*, as that in which the photosensitive drum 1*a* rotates, and a circumferential velocity of its rotation is controlled to be faster (herein, 1.2 times faster) than that of the rotation of the photosensitive drum 1*a*. The cleaning roller 27 is structured by, for example, forming, as the roller body, a foam body layer made of an EPDM rubber and having an Asker C hardness of 55° around a metal shaft. As a material of the roller body, without any limitation to an EPDM rubber, a rubber of any other type or a foamed rubber body of any other type of rubber may be used, and favorably used is such a material having an Asker C hardness in a range of 10° to 90°.

On the surface of the photosensitive drum 1*a*, on a downstream side in the rotation direction with respect to the contact surface with the cleaning roller 27, the cleaning blade 28 is fastened in a state of being in contact with the photosensitive drum 1*a*. The cleaning blade 28 is formed of, for example, a blade made of a polyurethane rubber and having a JIS hardness of 78°, and is mounted such that, at a contact point with the photosensitive drum 1*a*, it forms a prescribed angle with a photosensitive member tangential direction. A material, a hardness, dimensions, a biting amount into the photosensitive drum 1*a*, a press-contact force against the photosensitive drum 1*a*, and so on of the cleaning blade 28 are set as appropriate in accordance with specifications of the photosensitive drum 1*a*.

Residual toner removed from the surface of the photosensitive drum 1*a* by the cleaning roller 27 and the cleaning blade 28 is drained, as the collection screw 29 rotates, to the outside of the cleaning device 5*a* and conveyed to a toner collection container (not shown) to be stored therein. As toner used in this disclosure, there is used a type having a particle surface in which, as an abrasive, silica, titanium oxide, strontium titanate, alumina or the like is embedded and held so as to partly protrude on the surface, or a type having a surface to which an abrasive electrostatically adheres.

Upon a user's input of a command to start image formation, first, the surfaces of the photosensitive drums 1*a* to 1*d* are uniformly charged by the charging devices 2*a* to 2*d*, respectively, and then are irradiated with light by the exposure unit 4, so that electrostatic latent images corresponding to an image signal are formed on the photosensitive drums 1*a* to 1*d*, respectively. The developing devices 3*a* to 3*d* include the developing rollers 26 disposed to face the photosensitive drums 1*a* to 1*d*, respectively, and in the developing rollers 26, prescribed amounts of two-component developing agents containing toner of respective colors of yellow, cyan, magenta, and black are filled, respectively. By the developing rollers 26 of the developing devices 3*a* to 3*d*, the toner is supplied onto the photosensitive drums 1*a* to 1*d*, respectively, and electrostatically adheres thereto, and thus toner images corresponding to the electrostatic latent images formed by exposure from the exposure unit 4 are formed thereon.

Then, by the primary transfer rollers 6*a* to 6*d*, between each of the primary transfer rollers 6*a* to 6*d* and a corresponding one of the photosensitive drums 1*a* to 1*d*, an electric field is imparted at a prescribed transfer voltage to cause the toner images of yellow, cyan, magenta, and black on the photosensitive drums 1*a* to 1*d* to be primarily transferred onto the intermediate transfer belt 8. These images of the four colors are formed in a prescribed positional relationship preset for the formation of a prescribed full-color image. After that, in preparation for succeeding formation of new electrostatic latent images, toner remaining on the surfaces of the photosensitive drums 1*a* to 1*d* is removed by the cleaning devices 5*a* to 5*d*, respectively, and residual electric charge is removed by a static elimination lamp (not shown).

The intermediate transfer belt 8 is laid across a plurality of suspension rollers including a driven roller 10 and a drive roller 11. When, as the drive roller 11 is made to rotate by a drive motor (not shown), the intermediate transfer belt 8 starts to rotate in the clockwise direction, at a prescribed timing, a sheet of the transfer paper P is conveyed from the registration roller pair 12*b* to the secondary transfer roller 9 provided adjacently to the intermediate transfer belt 8, and at a nip portion (secondary transfer nip portion) between the intermediate transfer belt 8 and the secondary transfer roller 9, a full-color toner image is secondarily transferred onto the sheet of the transfer paper P. The sheet of the transfer paper P onto which the toner image has been transferred is conveyed to the fixing portion 7.

The sheet of the transfer paper P conveyed to the fixing portion 7 is heated and pressed when passing through a nip portion (fixing nip portion) between respective rollers of a fixing roller pair 13, and thus the toner image is fixed onto a surface of the sheet of the transfer paper P to form the prescribed full-color image thereon. A conveying direction of the sheet of the transfer paper P on which the full-color image has been formed is controlled by a branching portion 14 branching off in a plurality of directions. In a case where it is intended to form an image only on one side of the sheet of the transfer paper P, the sheet of the transfer paper P is directly ejected onto an ejection tray 17 by an ejection roller pair 15.

On the other hand, in a case where it is intended to form images on both sides of the sheet of the transfer paper P, a part of the sheet of the transfer paper P after having passed through the fixing portion 7 is once made to protrude from the ejection roller pair 15 to the outside of the apparatus. After that, the ejection roller pair 15 is made to rotate inversely so that, at the branching portion 14, the sheet of the transfer paper P is led into a reverse conveying path 18 along which the sheet of the transfer paper P is conveyed, with one side thereof on which the image has been formed turned upside down, again to the registration roller pair 12*b*. Then, by the secondary transfer roller 9, images to be transferred next, which have been formed on the intermediate transfer belt 8, are transferred onto the other side of the sheet of the transfer paper P, on which no images have been formed. The sheet of the transfer paper P onto which the images have thus been transferred is conveyed to the fixing portion 7, where the toner images are fixed, and then is ejected onto the ejection tray 17.

Figure 3:
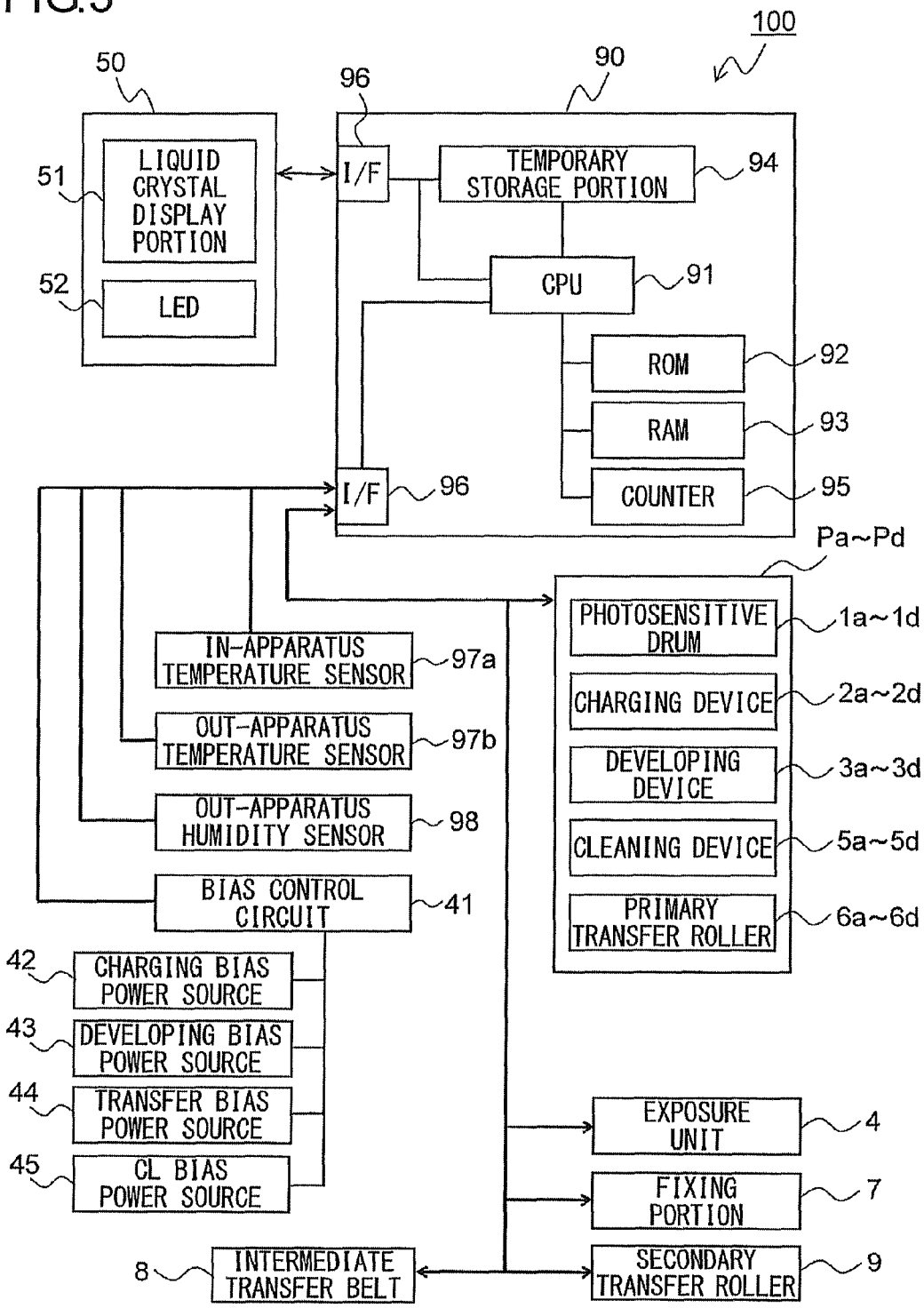
FIG. 3 is a block diagram showing a control route of the color printer 100 in the first embodiment of the present disclosure.

The description is directed next to a control route of an image forming apparatus of the present disclosure. FIG. 3 is a block diagram for explaining one embodiment of a controller used in the color printer 100 of the first embodiment of the present disclosure. In using the color printer 100, various forms of control are performed with respect to the various portions of the apparatus, which renders a control route of the color printer 100 as a whole complicated. Accordingly, the description is focused herein on parts of the control route required for implementing the present disclosure.

A control portion 90 includes at least a CPU (central processing unit) 91 as a central computation device, a ROM (read-only memory) 92 that is a read-only storage portion, a RAM (random access memory) 93 that is a readable and rewritable storage portion, a temporary storage portion 94 that temporarily stores image data and so on, a counter 95, and a plurality of I/Fs (interfaces) 96 that transmit control signals to the various devices in the color printer 100 and receive an input signal from an operation portion 50. Furthermore, the control portion 90 can be disposed at an arbitrary location inside the main body of the color printer 100.

In the ROM 92, programs for controlling the color printer 100, numerical values required for the control, data not to be changed during use of the color printer 100, and so on are contained. In the RAM 93, necessary data generated when control of the color printer 100 is in progress, data temporarily required for controlling the color printer 100, and so on are stored. The counter 95 counts the number of printed sheets. Instead of separately providing the counter 95, for example, the RAM 93 may be configured to store the number of printed sheets.

Furthermore, the control portion 90 transmits control signals from the CPU 91 to the various portions and devices in the color printer 100 via the I/Fs 96. Furthermore, from the various portions and devices, signals representing respective states thereof and input signals therefrom are transmitted to the CPU 91 via the I/Fs 96. The various portions and devices the control portion 90 controls in this embodiment include, for example, the image forming portions Pa to Pd, the exposure unit 4, the primary transfer rollers 6*a* to 6*d*, the fixing portion 7, the secondary transfer roller 9, an image input portion 40, a bias control circuit 41, and the operation portion 50.

The image input portion 40 is a reception portion that receives image data transmitted from a personal computer or the like to the color printer 100. An image signal inputted from the image input portion 40 is converted into a digital signal, which then is sent out to the temporary storage portion 94.

The bias control circuit 41 is connected to a charging bias power source 42, a developing bias power source 43, a transfer bias power source 44, and a cleaning bias power source 45 and, based on an output signal from the control portion 90, operates the power sources 42 to 45. Based on control signals from the bias control circuit 41, the power sources 42 to 45 are controlled so that the charging bias power source 42 applies a prescribed bias to the charging roller 22 in each of the charging devices 2*a* to 2*d*, the developing bias power source 43 applies a prescribed bias to the magnetic roller 25 and the developing roller 26 in each of the developing devices 3*a* to 3*d*, the transfer bias power source 44 applies a prescribed bias to the primary transfer rollers 6*a* to 6*d* and the secondary transfer roller 9, and the cleaning bias power source 45 applies a prescribed bias to the cleaning roller 27 in each of the cleaning devices 5*a* to 5*d*.

In the operation portion 50, a liquid crystal display portion 51 and an LED 52 that indicates various types of states are provided to indicate a state of the color printer 100 and to display a status of progress of image formation and the number of printed sheets. Various types of settings of the color printer 100 are performed from a printer driver of a personal computer.

In addition to the above, the operation portion 50 is provided with a stop/clear button that is used for, for example, halting image formation, a reset button that is used for bringing the various types of settings of the color printer 100 back to a default state, and so on.

An in-apparatus temperature sensor 97*a* detects a temperature inside the color printer 100, particularly, a temperature on a surface or a vicinity of each of the photosensitive drums 1*a* to 1*d* and is disposed in proximity to the image forming portions Pa to Pd. An out-apparatus temperature sensor 97*b* detects a temperature outside the color printer 100, and an out-apparatus humidity sensor 98 detects a humidity outside the color printer 100. The out-apparatus temperature sensor 97*b* and the out-apparatus humidity sensor 98 are installed, for example, in a neighborhood of an air suction duct (not shown) on a lateral side of the paper sheet cassette 16 shown in FIG. 1, which is unlikely to be affected by a heat generating portion, and can also be installed at any other location where a temperature or a humidity outside the color printer 100 can be detected with accuracy.

The color printer 100 of this embodiment is capable of executing a heating-up mode in which, at the time of non-image formation, for example, when the color printer 100 is started up from a power off state or a sleep (power saving) mode to a printing start state, an alternating current (AC) bias is applied to the charging roller 22 making contact with each of the photosensitive drums 1*a* to 1*d* to cause the surface of each of the photosensitive drums 1*a* to 1*d* to be heated up.

There is a large difference in electric resistance between the metallic shaft and the roller body made of a conductive material such as an epichlorohydrin rubber, which constitute the charging roller 22. Because of this, when an alternating current bias is applied to the charging roller 22, heat is generated between the shaft and the roller body or inside the roller body. The heat generated in the charging roller 22 is conducted to each of the photosensitive drums 1*a* to 1*d* and heats up the surface of each of the photosensitive drums 1*a* to 1*d*.

Furthermore, another possible principle based on which the surface of each of the photosensitive drums 1*a* to 1*d* heats up is as follows. That is, the charging roller 22 and the photosensitive drums 1*a* to 1*d* are formed of a dielectric substance. A relationship between the charging roller 22 and each of the photosensitive drums 1*a* to 1*d* is expressed by an equivalent circuit of a capacitor and a resistor shown in FIG. 4. When an electric field is applied to a dielectric substance, electrons and ions and so on present inside the dielectric substance are polarized, and resulting dipoles of positive and negative polarities attempt to be aligned in orientation with the electric field. In an electric field of a high-frequency alternating current of several Hz to several hundreds of MHz, in which polarities are reversed millions of times per second, friction due to vigorous motion of the dipoles attempting to follow such reversals of the electric field causes heat to be generated.

Figure 4:
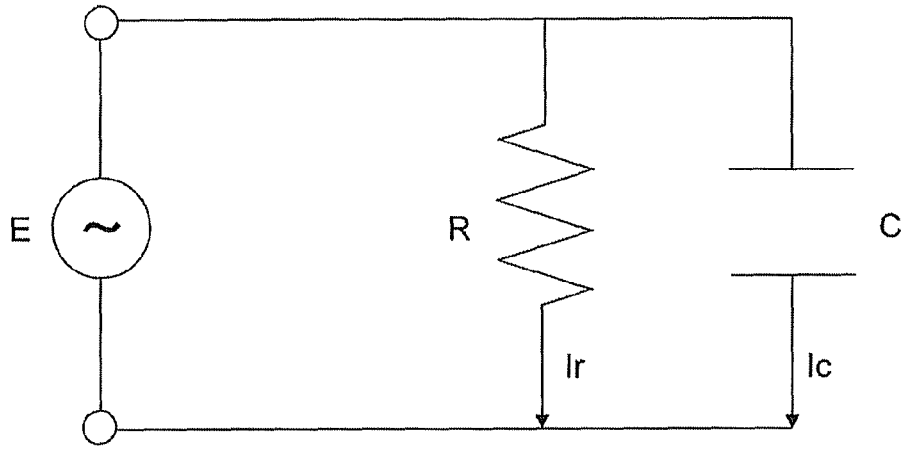
FIG. 4 is a diagram showing an equivalent circuit for explaining a principle based on which photosensitive drums 1*a* to 1*d* heat up by application of an alternating current bias to a charging roller 22.

For example, in the equivalent circuit of each of the photosensitive drums 1*a* to 1*d* and the charging roller 22 shown in FIG. 4, where an alternating current bias to be applied is denoted as E, a frequency as f, a resistance of a system as a whole as R, and a capacitance as C, with respect to Ir in phase with the application bias E, there occurs heat generation expressed by $P=E\times Ir$.

Herein, where an angular frequency $\omega=2\pi f$ and $|Ir(j\omega)|/|Ic(j\omega)|=\tan\delta$, $\tan\delta=1/(2\pi f\cdot CR)$ and $1/R=2\pi f\cdot C\cdot\tan\delta$ are obtained. A power P required for heat generation, therefore, is expressed by $P=E\cdot|Ir(j\omega)|=E^2/R=E^2\cdot(2\pi f\cdot C\cdot\tan\delta)$. Based on this, it can be said that heating-up is proportional to a square of the application bias E, the frequency f, and the capacitance C.

With this configuration, the photosensitive drums 1*a* to 1*d* themselves heat up, and thus compared with the method in which a heater is disposed inside or outside each of the photosensitive drums 1*a* to 1*d*, no energy is wasted by heating even unintended objects such as the atmosphere (air) in a vicinity of each of the photosensitive drums 1*a* to 1*d*, thus enabling efficient heating-up. In a case where a direct current (DC) bias is used as a bias to be applied to the charging roller 22, a resulting heating-up effect is none or extremely small, and thus it is required that an alternating current bias be applied.

Next, a relationship between whether or not the photosensitive drums 1*a* to 1*d* are driven to rotate and a heating-up effect on the photosensitive drums 1*a* to 1*d* was studied. In a tandem-type color printer 100 as shown in FIG. 1, as each of photosensitive drums 1*a* to 1*d*, an a-Si photosensitive member formed by layering an a-Si photosensitive layer on a surface of an aluminum elementary pipe having an outer diameter of 30 mm and a thickness of 2 mm was used, and a charging roller 22 having an outer diameter of 12 mm and a thickness of 2 mm was brought in contact therewith. At this time, a photosensitive drum-charging roller system as a whole had a capacitance C of 600 pF and a resistance R of 1.3 MΩ.

Furthermore, as a charging bias to be applied to the charging roller 22 in a heating-up mode, a bias obtained by superimposing an alternating current bias having a peak-to-peak value (Vpp)=1600 V on a direct current bias (Vdc) of 350 V was set. Also, as a charging bias to be applied to the charging roller 22 in a printing operation, a bias obtained by superimposing an alternating current bias having a peak-to-peak value (Vpp)=1200 V and a frequency of 2300 Hz on a direct current bias (Vdc) of 400 V was set.

Figure 5:
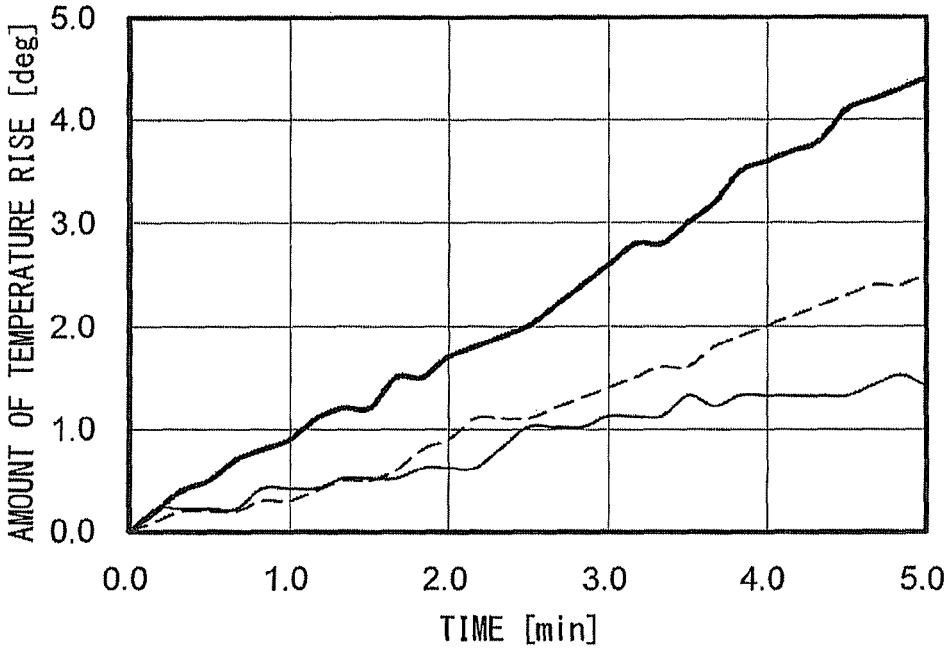
FIG. 5 is a graph showing an amount of temperature rise of the photosensitive drums 1*a* to 1*d* when a heating-up mode is executed in a state where the photosensitive drums 1*a* to 1*d* are driven to rotate at the same linear velocity as that used in a printing operation, in a state where the photosensitive drums 1*a* to 1*d* are driven to rotate at a linear velocity half that used in the printing operation, and in a state where the photosensitive drums 1*a* to 1*d* are stopped from rotating.

Then, there were measured variations in amount of temperature rise of a surface of each of the photosensitive drums 1*a* to 1*d* when, under an environment of 28° C. and 80% RH, the heating-up mode was executed in a state where the photosensitive drums 1*a* to 1*d* were driven to rotate at the same linear velocity (157 mm/sec) as that used in the printing operation, in a state where the photosensitive drums 1*a* to 1*d* were driven to rotate at a linear velocity (78.5 mm/sec) half that used in the printing operation, and in a state where the photosensitive drums 1*a* to 1*d* were stopped from rotating. FIG. 5 shows a result thereof.

As shown in FIG. 5, in a case where the heating-up mode was executed in the state where the photosensitive drums 1*a* to 1*d* were stopped from rotating (a thick line in FIG. 5), an amount of temperature rise in five minutes of the surface of each of the photosensitive drums 1*a* to 1*d* was 4.0 degrees or more. On the other hand, in a case where the heating-up mode was executed in the state where the photosensitive drums 1*a* to 1*d* were made to rotate at a linear velocity half that used in the printing operation (a broken line in FIG. 5), the amount of temperature rise in five minutes of the surface of each of the photosensitive drums 1*a* to 1*d* was 2.5 degrees, and in a case where the heating-up mode was executed in the state where the photosensitive drums 1*a* to 1*d* were made to rotate at the same linear velocity as that used in the printing operation (a solid line in FIG. 5), the amount of temperature rise in five minutes of the surface of each of the photosensitive drums 1*a* to 1*d* was 1.5 degrees. Conceivably, this is attributed to the fact that, when an alternating current bias is applied to the charging roller 22 while the photosensitive drums 1*a* to 1*d* are made to rotate, the photosensitive drums 1*a* to 1*d* are undesirably cooled by airflow generated around the photosensitive drums 1*a* to 1*d*, so that heating-up efficiency is deteriorated. Performing heating-up in the state where the photosensitive drums 1*a* to 1*d* are stopped from rotating avoids the possibility that the photosensitive drums 1*a* to 1*d* are cooled by airflow generated by their rotation, thus enabling efficient heating-up. For this reason, from the standpoint of heating-up efficiency, preferably, an alternating current bias is applied to the charging roller 22 in the state where the photosensitive drums 1*a* to 1*d* are stopped from rotating.

When, however, a bias is applied to the charging roller 22 in the state where the photosensitive drums 1*a* to 1*d* are stopped from rotating, discharge is concentrated at a portion of the surface of each of the photosensitive drums 1*a* to 1*d* where contact is made with the charging roller 22, and this brings about, at the time of image formation, a state where a potential at that portion is low compared with that at other portions. As a result, there is a possibility that, in an output image, streaks are generated in a shaft direction of the photosensitive drums 1*a* to 1*d*, i.e. an image defect occurs.

As a solution to the above, in the heating-up mode, a bias is applied to the charging roller 22 while the photosensitive drums 1*a* to 1*d* are made to rotate at a velocity lower than that used at the time of image formation. This can suppress cooling of the photosensitive drums 1*a* to 1*d* by airflow generated by its rotation, and avoids the possibility that discharge is concentrated at a portion of a surface of each of the photosensitive drums 1*a* to 1*d* where contact is made with the charging roller 22. As a result, it is possible, without deteriorating heating-up efficiency for the surface of each of the photosensitive drums 1*a* to 1*d*, to remove, with high efficiency, moisture on the surface of each of the photosensitive drums 1*a* to 1*d* in a short time, and thus to effectively suppress the occurrence of image deletion over a long period of time. Furthermore, it is also possible to suppress the occurrence of an image defect in the form of streaks due to discharge being concentrated. In order to prevent, as much as possible, deterioration in heating-up efficiency for the surface of each of the photosensitive drums 1*a* to 1*d*, preferably, a rotation velocity of the photosensitive drums 1*a* to 1*d* in the heating-up mode is sufficiently lower than that used at the time of image formation.

Next, a relationship between a factor of an alternating current bias to be applied to the charging roller 22 and a heating-up effect on the photosensitive drums 1*a* to 1*d* was studied. Specifications of the photosensitive drums 1*a* to 1*d* and the charging roller 22 of the color printer 100 were set to be similar to those in the foregoing study. Furthermore, respective charging biases to be applied to the charging roller 22 in a heating-up mode and in a printing operation also were set similarly to those in the foregoing study.

Figure 6:
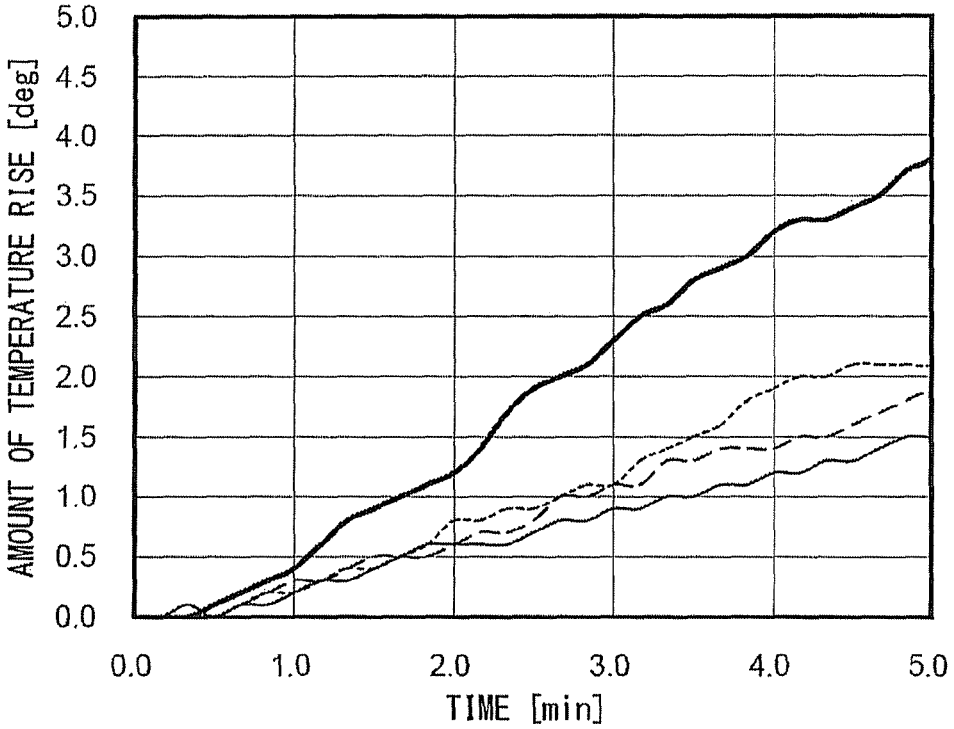
FIG. 6 is a graph showing an amount of temperature rise of the photosensitive drums 1*a* to 1*d* when the heating-up mode is executed while a frequency f of an alternating current bias to be applied to the charging roller 22 is made to vary.

Then, there were measured variations in amount of temperature rise of a surface of each of the photosensitive drums 1*a* to 1*d* when, under an environment of 28° C. and 80% RH, the heating-up mode was executed in a state where the photosensitive drums 1*a* to 1*d* were stopped from rotating, and a frequency f of an alternating current bias to be applied to the charging roller 22 was made to vary in a range of 2400 Hz to 5000 Hz. FIG. 6 shows a result thereof. In FIG. 6, an amount of temperature rise at the frequency f of 2400 Hz is indicated by a solid line, an amount of temperature rise at the frequency f of 3000 Hz by a broken line, an amount of temperature rise at the frequency f of 4000 Hz by a dotted line, and an amount of temperature rise at the frequency f of 5000 Hz by a thick line.

As is evident from FIG. 6, the higher the frequency f of an alternating current bias to be applied to the charging roller 22, the larger the amount of temperature rise of the surface of each of the photosensitive drums 1*a* to 1*d*. It is known that a relative humidity at which no image deletion occurs is 70% or lower, and in order for a relative humidity to be decreased to 70% or lower under the environment of 28° C. and 80% RH, it is required that the photosensitive drums 1*a* to 1*d* be heated up to a surface temperature of 30.2° C. or higher.

To this end, a target value of the amount of temperature rise is set to (30.2−28.0)=2.2 (deg.), in which case it is found from FIG. 6 that a length of time required for heating-up is 2.8 minutes at the frequency f of 5000 Hz, 4.2 minutes at the frequency f of 4000 Hz, and 5 minutes or more at the frequency f of 3000 Hz or lower. Normally, in the color printer 100, a length of time required for warm-up is set to about 5 minutes. Based on this, under the environment of 28° C. and 80% RH, the frequency f is set to 4000 Hz or higher, and thus the photosensitive drums 1*a* to 1*d* can be heated up, within a length of time required for warm-up, to a surface temperature at which no image deletion occurs.

Furthermore, an amount of temperature rise of the surface of each of the photosensitive drums 1*a* to 1*d* required for preventing image deletion varies depending on a surrounding environment (temperature and humidity) of the color printer 100. For this reason, an environment correction table in which an optimum bias application time corresponding to each surrounding environment is preset is stored beforehand in the ROM 92 (or the RAM 93), and at the time of executing the heating-up mode, an alternating current bias is applied continuously only for a minimum length of time required for removing moisture on the surface of each of the photosensitive drums 1*a* to 1*d*. This reduces a user's waiting time as much as possible and thus can enhance image formation efficiency to a maximum extent.

Though not specified herein, in a case where the frequency f was set to 2300 Hz similarly to that in the printing operation, no sufficient heating-up effect was observed. It has been confirmed from this result that, by setting the frequency f of an alternating current bias to be applied to the charging roller 22 to be higher than that used in the printing operation, the photosensitive drums 1*a* to 1*d* can be effectively heated up.

By the way, in the heating-up mode executed in the color printer 100, as described earlier, an alternating current bias is applied to the charging roller 22 in a state different from that in the printing operation, i.e. in a state where the photosensitive drums 1*a* to 1*d* are stopped from rotating or a state where the photosensitive drums 1*a* to 1*d* rotate at a low velocity compared with the velocity at which they rotate in the printing operation, and in such a state, it is likely that a discharge region is concentrated at a given area of the surface of each of the photosensitive drums 1*a* to 1*d*. As a result, when an excessive alternating current bias is undesirably applied to the charging roller 22, there is a possibility that exchange of discharged electric charge promotes electrostatic destruction (breakdown) of the photosensitive layer, leading to the occurrence of an image defect such as color spots or color streaks. Furthermore, there is also a possibility that a conductive material constituting the charging roller 22 might be altered in quality or degraded. Thus, there arises a need to apply an appropriate alternating current bias to the charging roller 22.

Figure 7:
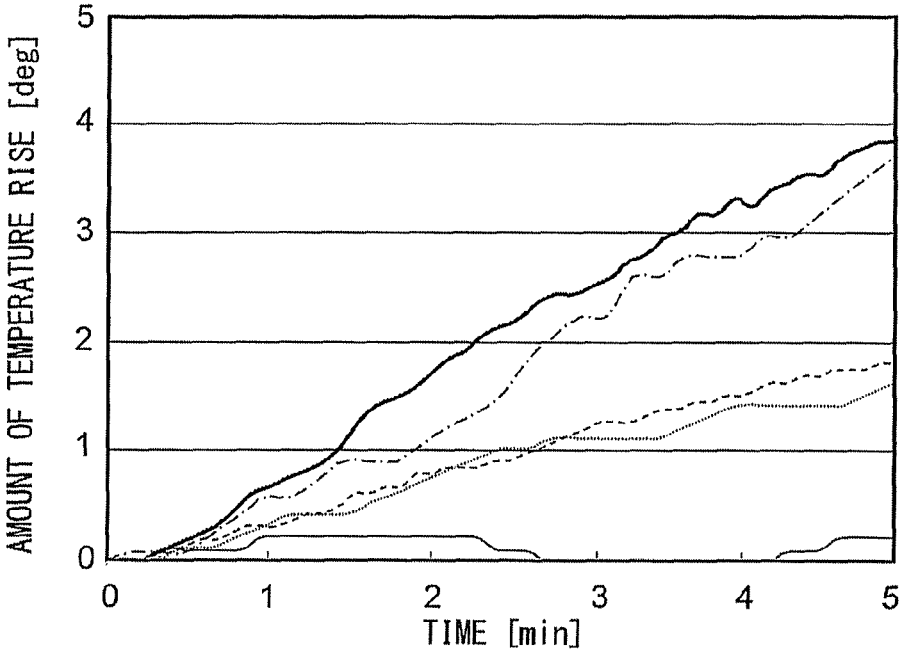
FIG. 7 is a graph showing an amount of temperature rise of the photosensitive drums 1*a* to 1*d* when the heating-up mode is executed while the frequency f and Vpp of an alternating current bias to be applied to the charging roller 22 are made to vary.

In order to set a peak-to-peak value (Vpp) of an appropriate alternating current bias to be applied to the charging roller 22, under test conditions similar to those in the case shown in FIG. 5, there were measured variations in amount of temperature rise of a surface of each of the photosensitive drums 1*a* to 1*d* when a frequency f of an alternating current bias to be applied to the charging roller 22 was made to vary to be 3000 Hz and 5000 Hz, and Vpp thereof was made to vary in a range of 1000 V to 1600 V. FIG. 7 shows a result thereof. In FIG. 7, with respect to the frequency f of 3000 Hz, an amount of temperature rise at Vpp of 1000 V is indicated by a solid line, an amount of temperature rise at Vpp of 1200 V by a dotted line, and an amount of temperature rise at Vpp of 1600 V by a broken line. Furthermore, with respect to the frequency f of 5000 Hz, an amount of temperature rise at Vpp of 1200 V is indicated by an alternate long and short dashed line, and an amount of temperature rise at Vpp of 1600 V by a thick line.

As is evident from FIG. 7, depending on Vpp of an alternating current bias to be applied to the charging roller 22, a heating-up characteristic of the surface of each of the photosensitive drums 1*a* to 1*d* varies, and by applying an alternating current bias having Vpp of 1200 V, there can be obtained a heating-up effect similar to that obtained in a case where an alternating current bias having Vpp of 1600 V is applied. It is found that in a case, on the other hand, where an alternating current bias having Vpp of 1000 V is applied, almost no heating-up effect is exhibited. At this time, Vpp of 1200 V at which the heating-up effect was observed is twice as large as a discharge start voltage Vth between the charging roller 22 and each of the photosensitive drums 1*a* to 1*d*.

The term "discharge start voltage" used in this specification is assumed to refer to a voltage value at which, when a direct current bias is applied to the charging roller 22, and a voltage value of the direct current bias is gradually increased, discharge occurs between the charging roller 22 and each of the photosensitive drums 1*a* to 1*d*.

That is, with an alternating current bias having a value of Vpp twice or more as large as the discharge start voltage Vth set as an alternating current bias value to be applied to the charging roller 22, the photosensitive drums 1*a* to 1*d* can be heated up. Particularly, by setting Vpp of the alternating current bias to be twice as large as the discharge start voltage Vth, the photosensitive drums 1*a* to 1*d* can be heated up while a stable discharge state is maintained. As a result, with damage to the photosensitive layer due to application of an excessive voltage suppressed to a minimum, the occurrence of image deletion can be effectively suppressed.

In summary of the results described above, the following is found. That is, at the time of executing the heating-up mode, it is appropriate to apply an alternating current bias having a value of Vpp twice or more as large as the discharge start voltage Vth between the charging roller 22 and each of the photosensitive drums 1*a* to 1*d*, and it is more preferable to apply an alternating current bias having a frequency higher than that used in the printing operation.

Herein, the discharge start voltage Vth varies even depending on an environment in which the color printer 100 is installed, a resistance of the charging roller 22, and so on. Because of this, in order to maintain constant heating-up efficiency for the photosensitive drums 1*a* to 1*d*, preferably, the discharge start voltage Vth is measured at every prescribed time interval, and based on a value of the discharge start voltage Vth thus measured, Vpp of an alternating current bias to be applied to the charging roller 22 is determined. Furthermore, even with the same value of Vpp, the larger the frequency f, the higher a heating-up effect on the photosensitive drums 1*a* to 1*d*, and thus, preferably, the frequency f is set to a value somewhat higher than necessary so that a heating-up time (alternating current bias application time) is reduced, thereby to reduce damage to the photosensitive layer.

Figure 8:
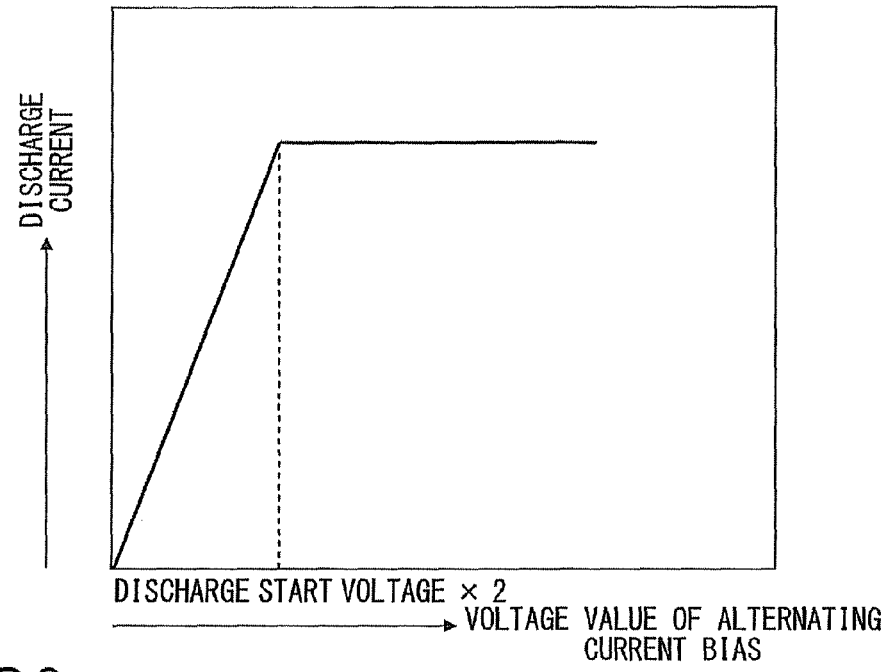
FIG. 8 is a graph showing how a discharge current changes with an increase in Vpp of an alternating current bias to be applied to the charging roller 22.

The discharge start voltage Vth is measured by, for example, the following method. That is, when a discharge current is measured while Vpp of an alternating current bias is increased, as shown in FIG. 8, the discharge current increases in proportion to Vpp and, upon Vpp reaching a prescribed value, stops increasing to exhibit a substantially constant discharge current value. This value of Vpp as a diffraction point of the discharge current is twice as large as the discharge start voltage Vth. In addition to a discharge current value, a surface potential of the photosensitive drums 1*a* to 1*d* or the like also exhibits a tendency similar to that shown in FIG. 8, and thus it is also possible to measure the discharge start voltage Vth based on variations in surface potential of the photosensitive drums 1*a* to 1*d*.

While in the foregoing embodiment, the heating-up mode is executed by applying an alternating current bias to the charging roller 22, a member to which an alternating current bias is applied is not limited to the charging roller 22 and may be any conductive member that makes contact with each of the photosensitive drums 1*a* to 1*d*. Examples of such a conductive member include the cleaning roller 27. An alternating current bias is applied to the cleaning roller 27 by the cleaning bias power source 45.

Furthermore, when a bias is applied to a conductive member that is used in such a manner that a bias is applied thereto in a printing operation, such as the charging roller 22, also at a time other than in the printing operation, there is a possibility that degradation of the conductive member is accelerated to shorten a service life. When, however, as a conductive member to which a bias is applied at a time other than in the printing operation, a member to which no bias is applied in the printing operation, such as the cleaning roller 22, is used, it is no longer required to take into consideration a service life being shortened due to application of a bias.

By the way, in many cases, conductive members making contact with each of the photosensitive drums 1*a* to 1*d*, such as, for example, the charging roller 22 and the cleaning roller 27, are each formed by fastening, with the use of an adhesive, a roller body made of a conductive material to a metallic shaft, and therefore, when a high-frequency alternating current bias is applied thereto, there is a possibility that partial exfoliation of the adhesive occurs to cause charging unevenness. As a solution to this, there is used a charging roller 22 and a cleaning roller 27 each formed by fastening, without the use of an adhesive, the roller body to the metallic shaft. In this case, when a high-frequency alternating current bias is applied thereto, there occurs no exfoliation between the conductive material and the shaft, and the photosensitive drums 1*a* to 1*d* can be heated up in a short time. As a method for fastening, without the use of an adhesive, the roller body to the metallic shaft, for example, a method in which the shaft is press-inserted into the roller body and fastened therein is used.

Next, a description is given of a color printer 100 according to a second embodiment of the present disclosure. A configuration and a control route of the color printer 100 are similar to those in the first embodiment shown in FIGS. 1 to 3. In the color printer 100 of this embodiment, a frequency f of an alternating current bias to be applied to a charging roller 22 in a heating-up mode is changed in accordance with a use environment (temperature and humidity) of the color printer 100.

As described earlier, the more the frequency f of an alternating current bias is increased, the higher a heating-up effect on photosensitive drums 1*a* to 1*d*. When, however, the frequency f is increased, it becomes likely that by-products of electrical discharge adhere to a surface of each of the photosensitive drums 1*a* to 1*d*. As a result, a friction coefficient μ of the surface of each of the photosensitive drums 1*a* to 1*d* is increased, which leads to the occurrence of curing up of a cleaning blade 28 and frictional noise.

In an environment in which image deletion is likely to occur, such as under a high-temperature and high-humidity environment, it is required that the photosensitive drums 1*a* to 1*d* be sufficiently heated up so that image deletion is suppressed and so that a user's waiting time is reduced to increase convenience. To this end, based on a temperature (in-apparatus temperature) and a humidity (in-apparatus humidity) inside the color printer 100, the frequency f of an alternating current bias to be applied to the charging roller 22 is changed.

Figure 9:
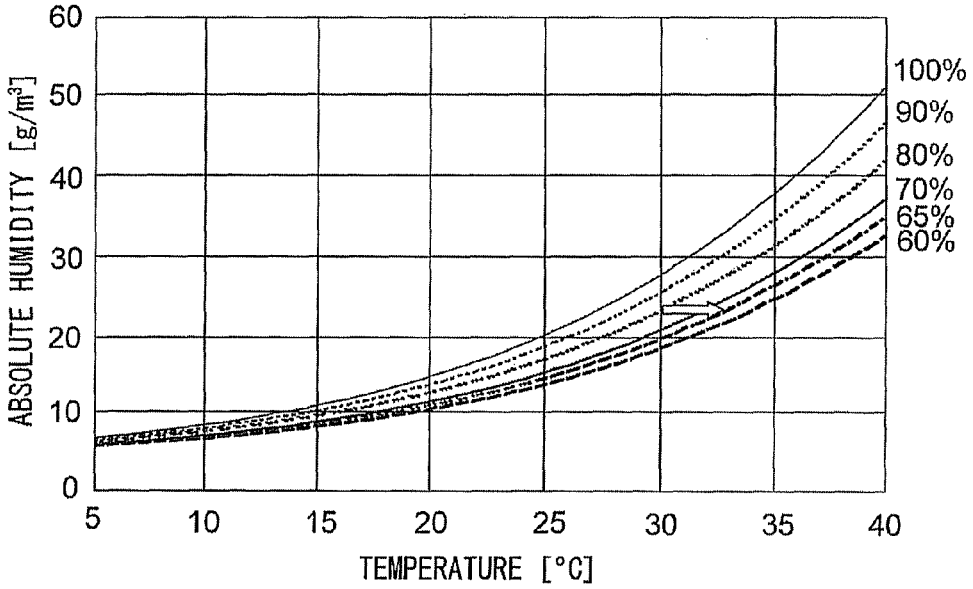
FIG. 9 is a graph showing a relationship between an in-apparatus temperature (° C.) and an absolute humidity ($g/cm^3$) at a relative humidity of 60%, 65%, 70%, 80%, 90%, and 100%.

FIG. 9 is a graph (saturated steam curve) showing a relationship between an in-apparatus temperature (° C.) and an absolute humidity (g/cm$^3$) at a relative humidity of 60%, 65%, 70%, 80%, 90%, and 100%. For example, assuming that the color printer 100 is installed under an environment of 30° C. and a relative humidity of 80%, conceivably, an environment similar thereto has been established in a neighborhood of each of the photosensitive drums 1*a* to 1*d* inside the color printer 100. Based on FIG. 9, an absolute humidity at an in-apparatus temperature of 30° C. and a relative humidity of 80% is 24. 3 g/cm$^3$.

Herein, assuming that the absolute humidity, which represents an amount of moisture in the air, does not vary even when the in-apparatus temperature varies, when a surface temperature of the photosensitive drums 1*a* to 1*d* is increased, as shown by an arrow in FIG. 9, the relative humidity is decreased. For example, when the surface temperature of the photosensitive drums 1*a* to 1*d* is increased to 33.9° C., the relative humidity is decreased to 65%, so that no image deletion occurs.

Where the in-apparatus temperature is denoted as IT [° C.], an in-apparatus relative humidity as IH [% RH], the surface temperature of the photosensitive drums 1*a* to 1*d* as PT [° C.], and a relative humidity in a neighborhood of the surface of each of the photosensitive drums 1*a* to 1*d* as PH [% RH], an in-apparatus saturated steam pressure e (IT), an in-apparatus saturated steam amount a (IT), an in-apparatus absolute humidity A (IH), and a saturated steam pressure e (PT) in a neighborhood of each of the photosensitive drums 1*a* to 1*d* are expressed by equations below, respectively.

$$e(IT)=6.1078*10^{7.5*IT/(IT+237.3)}\ [\text{hPa}]$$

$$a(IT)=217*e(IT)/(IT+273.15)\ [\text{g/m}^3]$$

$$A(IH)=a(IT)*IH/100\ [\text{g/m}^3]$$

$$e(PT)=6.1078*10^{7.5*PT/(PT+237.3)}\ [\text{hPa}]$$

Figure 10:
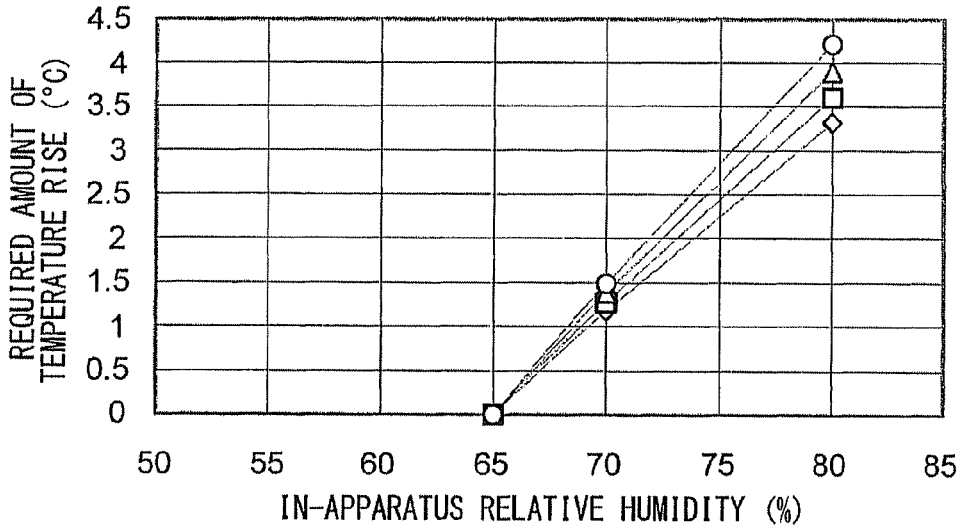
FIG. 10 is a graph showing an amount of temperature rise of a surface temperature of the photosensitive drums 1*a* to 1*d* required for a relative humidity in a neighborhood of each of the photosensitive drums 1*a* to 1*d* to be decreased to 65% or lower.

FIG. 10 is a graph showing an amount of temperature rise of the surface temperature of the photosensitive drums 1*a* to 1*d* required for the relative humidity in the neighborhood of each of the photosensitive drums 1*a* to 1*d* to be decreased to 65% or lower. In FIG. 10, a required amount of temperature rise at an in-apparatus temperature of 10° C. is represented by a data series connecting diamond symbols, a required amount of temperature rise at an in-apparatus temperature of 20° C. by a data series connecting square symbols, a required amount of temperature rise at an in-apparatus temperature of 30° C. by a data series connecting triangle symbols, and a required amount of temperature rise at an in-apparatus temperature of 40° C. by a data series connecting circle symbols.

As is evident from FIG. 10, a required amount of temperature rise varies depending on an in-apparatus temperature and humidity condition, and the higher the in-apparatus temperature and the in-apparatus relative humidity, the more the required amount of temperature rise is increased. Thus, it is effective that, as shown in FIG. 6, the frequency f is changed in accordance with an environment in which the color printer 100 is installed. To be specific, under a high-temperature and high-humidity environment, the frequency f is set to be increased, so that a heating-up effect on the photosensitive drums 1*a* to 1*d* is enhanced, and a user's waiting time can be reduced. On the other hand, under a low-temperature and low-humidity environment, the frequency f is set to be decreased, so that an increase in the friction coefficient μ of the surface of each of the photosensitive drums 1*a* to 1*d* can be suppressed.

The in-apparatus temperature is constantly detected at every prescribed time interval by the in-apparatus temperature sensor 97*a*. Furthermore, on an assumption that an absolute moisture amount (which depends on a temperature) is the same outside and inside the apparatus, the in-apparatus relative humidity is calculated based on an out-apparatus humidity, which is constantly detected at every prescribed time interval by the out-apparatus humidity sensor 98, and the in-apparatus temperature.

The frequency changing in the heating-up mode is performed, preferably, by using a temperature and a humidity that are detected as immediately as possible before the frequency changing is executed and may also be performed by using a temperature and a humidity that are detected at any other timing. Furthermore, the following is also possible. That is, a temperature and a humidity are detected a prescribed number of times, and the frequency changing is performed by using average values of temperature and humidity values thus detected.

Next, a description is given of a color printer 100 according to a third embodiment of this disclosure. A configuration and a control route of the color printer 100 are similar to those in the first embodiment shown in FIGS. 1 to 3. In the color printer 100 of this embodiment, a frequency f of an alternating current bias to be applied to a charging roller 22 in a heating-up mode is changed in accordance with a cumulative number of sheets printed since the start of use of photosensitive drums 1*a* to 1*d*.

Typically, after long-term use, an a-Si photosensitive drum is oxidized at a photosensitive layer thereof and thus becomes more likely to absorb water molecules and by-products of electrical discharge. Also, a compounding agent in the charging roller 22 starts to leak out. Because of this, as a duration of use of a drum unit including the photosensitive drums 1*a* to 1*d* increases, the occurrence of image deletion becomes pronounced, as a result of which it takes a long time to resolve image deletion compared with the time it takes at an early stage of use.

This embodiment adopts a configuration in which a frequency of an alternating current bias to be applied to the charging roller 22 is made to vary in accordance with a cumulative number of sheets (durable number of sheets) printed since the start of use of the photosensitive drums 1*a* to 1*d*, which is counted by the counter 95 (see FIG. 3). Thus, even at a final stage of a service life of the drum unit, image deletion can be resolved in a short time.

Normally, a warm-up time of the color printer 100 is set to about 5 minutes. Based on this, under an environment of 28° C. and 80% RH, the heating-up mode was executed while the frequency f of an alternating current bias to be applied to the charging roller 22 was made to vary, and a study was performed to determine whether or not image deletion could be resolved within 5 minutes with respect to an energization time (cumulative number of printed sheets) from the start of use of each of the photosensitive drums 1*a* to 1*d*.

In the study, specifications of the photosensitive drums 1*a* to 1*d* and the charging roller 22 of the color printer 100 were set to be similar to those in the first embodiment. Furthermore, a charging bias to be applied to the charging roller 22 in the heating-up mode was obtained by using, similarly to the first embodiment, a direct current bias (Vdc) of 350 V and an alternating current bias having a peak-to-peak value (Vpp) of 1600 V, and a charging bias to be applied to the charging roller 22 in a printing operation was obtained by using, also similarly to the first embodiment, a direct current bias (Vdc) of 400 V and an alternating current bias having a peak-to-peak value (Vpp) of 1200 V and a frequency of 2300 Hz. Table 1 shows a result thereof.

TABLE 1

| Cumulative Number of Printed Sheets | 4000 Hz | 5000 Hz | 6000 Hz | 7000 Hz |
|---|---|---|---|---|
| 0 k | Resolved | Resolved | Resolved | Resolved |
| 50 k | Resolved | Resolved | Resolved | Resolved |
| 100 k | Not Resolved | Resolved | Resolved | Resolved |
| 300 k | Not Resolved | Not Resolved | Resolved | Resolved |
| 600 k | Not Resolved | Not Resolved | Not Resolved | Resolved |

As shown in Table 1, with respect to a cumulative number of printed sheets of up to 50 k sheets (50,000 sheets), image deletion was resolved within 5 minutes by applying an alternating current bias having a frequency of 4000 Hz. As the cumulative number of printed sheets increased beyond that number to 100 k sheets (100,000 sheets), further to 300 k sheets (300,000 sheets), and still further to 600 k sheets (600,000 sheets), a frequency of an alternating current bias required for resolving image deletion within 5 minutes also increased to 5000 Hz, further to 6000 Hz, and still further to 7000 Hz.

As this result shows, by setting beforehand the frequency to be small (4000 Hz or lower) at an early stage of use of the photosensitive drums 1*a* to 1*d* and increasing the frequency in stages in accordance with an increase in cumulative number of printed sheets, with the occurrence of image deletion effectively suppressed over an entire service life of the photosensitive drums 1*a* to 1*d*, an increase in the friction coefficient μ of a surface of each of the photosensitive drums 1*a* to 1*d* can be suppressed, and a warm-up time can be reduced.

Next, a description is given of a color printer 100 according to a fourth embodiment of the present disclosure. A configuration and a control route of the color printer 100 are similar to those in the first embodiment shown in FIGS. 1 to 3. In the color printer 100 of this embodiment, at the time of executing a heating-up mode, an alternating current bias having such a high frequency that no discharge occurs between a charging roller 22 and each of photosensitive drums 1*a* to 1*d* is applied to the charging roller 22.

Figure 11:
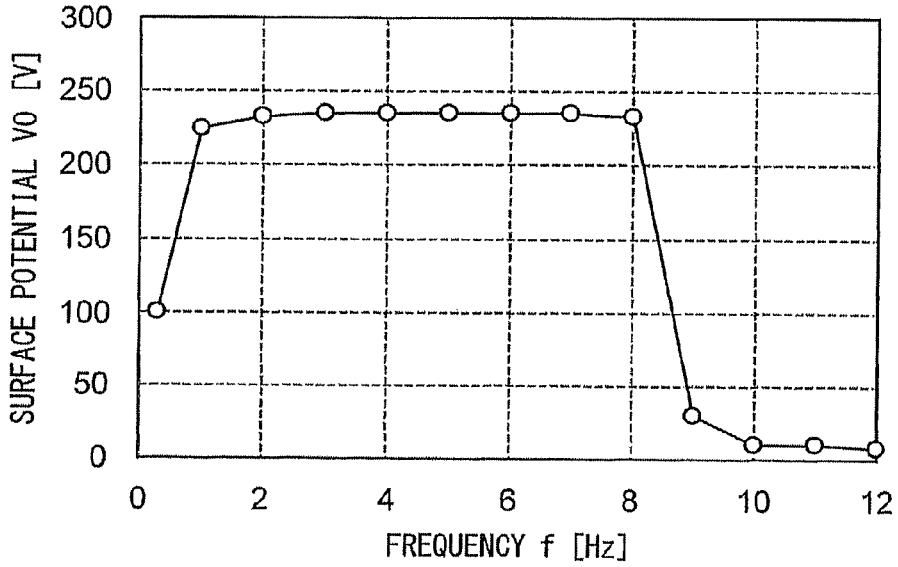
FIG. 11 is a graph showing variations in a surface potential V0 of the photosensitive drums 1*a* to 1*d* when the frequency f of an alternating current bias to be applied to the charging roller 22 is made to vary from 0 kHz through 12 kHz.

FIG. 11 is a graph showing variations in a surface potential V0 of the photosensitive drums 1*a* to 1*d* when a frequency f of an alternating current bias to be applied to the charging roller 22 is made to vary from 0 kHz through 12 kHz. Other test conditions were set to be similar to those in the cases shown in FIGS. 5 and 6.

Furthermore, Table 2 shows a relationship between a length of time it takes for a surface of each of the photosensitive drums 1*a* to 1*d* to be heated to reach a target temperature (herein, 30.2° C.) when the frequency f of an alternating current bias is made to vary from 4 kHz through 10 kHz and damage to the photosensitive drums 1*a* to 1*d* and the charging roller 22. In Table 2, damage to the photosensitive drums 1*a* to 1*d* and the charging roller 22 was determined by visually observing a level of occurrence of roller streaks at the time of outputting a halftone image, and a level at which the occurrence of roller streaks is pronounced and that thus is practically problematic is denoted as "Highly Observed", a level at which the occurrence of roller streaks is observed and that yet is not practically problematic as "Observed", and a level at which no occurrence of roller streaks is observed as "Not Observed".

TABLE 2

| Frequency | Heating-up Speed for Attaining Target Temperature | Damage to Photosensitive Drums • Charging Roller |
|---|---|---|
| 4 kHz | 4.2 mins. | Highly Observed |
| 6 kHz | 2.5 mins. | Highly Observed |
| 8 kHz | 2.1 mins. | Observed |
| 10 kHz | 2.0 mins. | Not Observed |

As shown in FIG. 11, it is found that, with respect to the frequency f of an alternating current bias to be applied to the charging roller 22 of 1 kHz to 8 kHz, the surface potential V0 has a value as high as 230 V to 250 V, and with respect to the frequency f of 8 kHz or higher, V0 sharply decreases. This is because of the following reason. That is, in a conductive material constituting the charging roller 22, an ion conductive agent is used, and when the frequency f of an alternating current bias is set to a high frequency of a given value or higher, ions in the conductive material can no longer oscillate following the frequency f, so that discharge no longer occurs.

Furthermore, as shown in Table 2, it has been confirmed that as the frequency f becomes higher, a heating-up speed at which the surface of each of the photosensitive drums 1*a* to 1*d* is heated up becomes faster, and at the frequency f of 8 kHz or higher, damage to the photosensitive drums 1*a* to 1*d* and the charging roller 22 is also reduced.

From this viewpoint, in this embodiment, by making use of a frequency characteristic described above, an alternating current bias having such a high frequency that no discharge occurs between the charging roller 22 and each of the photosensitive drums 1*a* to 1*d* is applied to the charging roller 22, and thus the photosensitive drums 1*a* to 1*d* can be heated up, with only oscillations of electrons and ions caused. As a result, with damage to a photosensitive layer due to a bias being concentrated at a given location suppressed to a minimum, the occurrence of image deletion can be effectively suppressed.

Next, a description is given of a color printer 100 according to a fifth embodiment of the present disclosure. A configuration and a control route of the color printer 100 are similar to those in the first embodiment shown in FIGS. 1 to 3. In the color printer 100 of this embodiment, at the time of executing a heating-up mode, in addition to an alternating current bias, a direct current bias not higher than a discharge start voltage Vth between a charging roller 22 and each of photosensitive drums 1*a* to 1*d* is applied to the charging roller 22.

Figure 12:
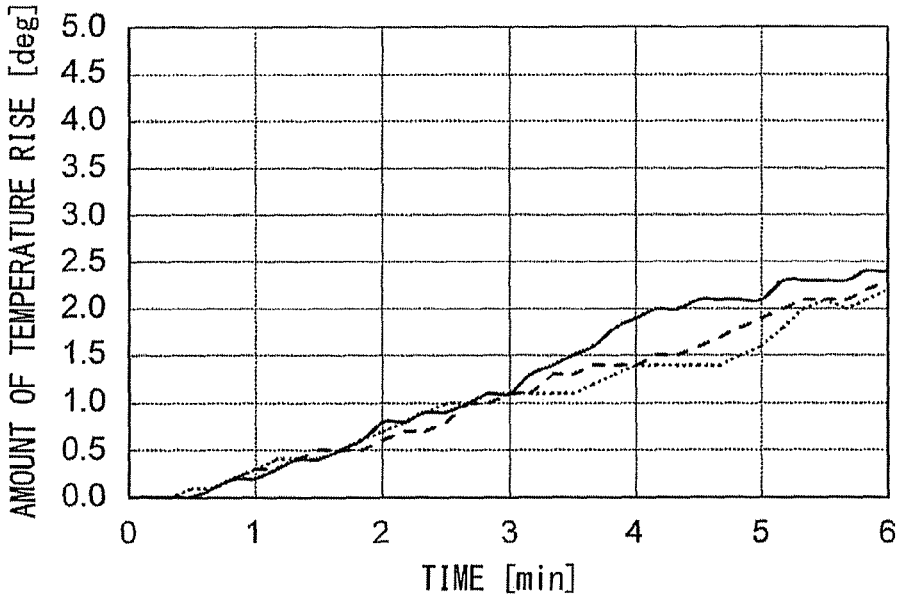
FIG. 12 is a graph showing variations in amount of temperature rise of a surface of each of the photosensitive drums 1*a* to 1*d* when the frequency f of an alternating current bias to be applied to the charging roller 22 is fixed to 3000 Hz, Vpp thereof is fixed to 1600 V, and a direct current bias Vdc to be applied thereto is made to vary in three stages at 0, 350 V, and 500 V.
Figure 13:
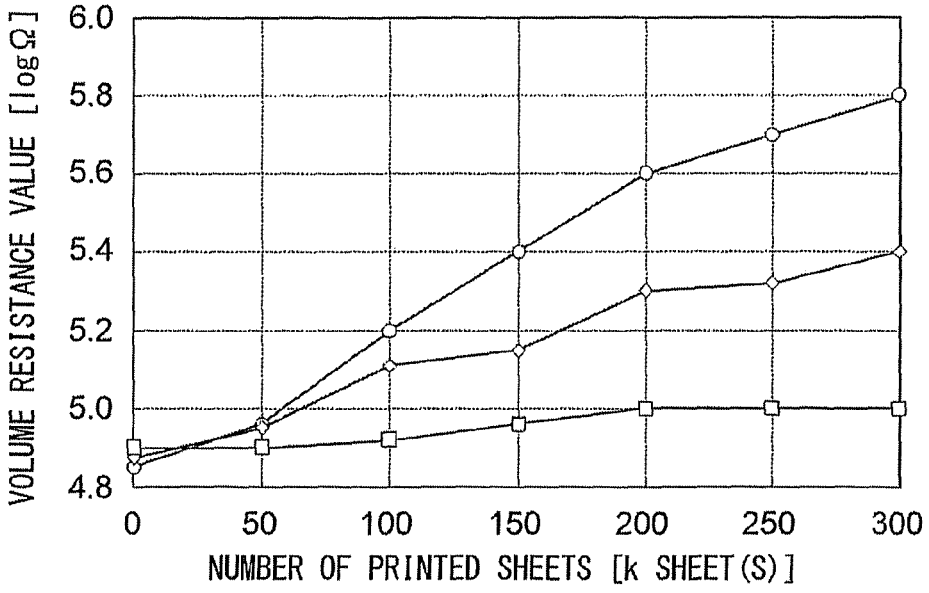
FIG. 13 is a graph showing variations in volume resistance value of the charging roller 22 after durability printing when the frequency f of an alternating current bias to be applied to the charging roller 22 is fixed to 3000 Hz, Vpp thereof is fixed to 1600 V, and the direct current bias Vdc to be applied thereto is made to vary in three stages at 0, 350 V, and 500 V.

FIG. 12 and FIG. 13 are graphs respectively showing variations in amount of temperature rise of a surface of each of the photosensitive drums 1*a* to 1*d* and variations in volume resistance value of the charging roller 22 after durability printing, when a frequency f of an alternating current bias to be applied to the charging roller 22 is fixed to 3000 Hz, Vpp thereof is fixed to 1600 V, and a direct current bias Vdc to be applied thereto is made to vary in three stages at 0, 350 V, and 500 V. Other test conditions were set to be similar to those in the cases shown in FIGS. 5 and 6.

As shown in FIG. 12, it has been confirmed that, when the frequency f and Vpp of an alternating current bias are set to be constant, the amount of temperature rise of the surface of each of the photosensitive drums 1*a* to 1*d* is substantially constant regardless of a value of the direct current bias Vdc. It is found that, when a target value of the amount of temperature rise is set to (30.2−28.0)=2.2 (deg.), a length of time required for heating-up is about 6 minutes at any of the values of the direct current bias Vdc of 0, 350 V, and 500 V.

Furthermore, as shown in FIG. 13, it has been confirmed that as the direct current bias Vdc becomes higher, the volume resistance value of the charging roller 22 after durability printing increases, and in a case where the direct current bias Vdc is set to 0, even after 300 k sheets (300,000 sheets) have been printed, almost no increase occurs in the volume resistance value of the charging roller 22.

In a printing operation, the direct current bias Vdc is applied to the charging roller 22 having a prescribed resistance and a prescribed dielectric constant so that the photosensitive drums 1*a* to 1*d* are charged to a surface potential of a desired value. On the other hand, in the heating-up mode, as described earlier, an alternating current bias having periodicity is applied to the charging roller 22 to cause the charging roller 22 to generate heat, and a direct current bias, therefore, is not necessarily required for causing the charging roller 22 to generate heat.

In fact, applying the direct current bias Vdc causes a compounding agent or the like in the charging roller 22 to be undesirably flowed out toward the photosensitive drums 1*a* to 1*d*, resulting in an increase in voltage resistance value of the charging roller 22. As a result, a service life of the charging roller 22 is shortened. Furthermore, there are also problems that by-products of electrical discharge adhere to a portion of the surface of each of the photosensitive drums 1*a* to 1*d* where contact is made with the charging roller 22, and that leakage occurs due to breakdown.

As a solution to the above, this embodiment adopts a configuration in which a direct current bias to be applied to the charging roller 22 at the time of executing the heating-up mode is set to be as low as possible so that degradation of the charging roller 22 is suppressed. To be specific, a direct current bias to be applied to the charging roller 22 is set to be not higher than the discharge start voltage Vth, and thus, with the service life of the charging roller 22 secured, it is possible to suppress adhering of by-products of electrical discharge to the surface of each of the photosensitive drums 1*a* to 1*d* and the occurrence of leakage due to breakdown.

Furthermore, when a direct current bias to be applied to the charging roller 22 at the time of executing the heating-up mode is set to 0, degradation of the charging roller 22 and the photosensitive drums 1*a* to 1*d* can be further suppressed. Moreover, when, at the time of executing the heating-up mode, a direct current bias of a polarity (herein, a negative polarity) opposite to a polarity (herein, a positive polarity) of a direct current bias to be applied in the printing operation is applied to the charging roller 22, polarized ions can be depolarized, and thus it also is possible to prolong the service life of the charging roller 22.

Next, a description is given of a color printer 100 according to a sixth embodiment of the present disclosure. A configuration and a control route of the color printer 100 are similar to those in the first embodiment shown in FIGS. 1 to 3. The color printer 100 of this embodiment is capable of executing a heating-up mode in which, at the time of non-image formation, an alternating current bias is applied to a charging roller 22 and a cleaning roller 27 making contact with each of photosensitive drums 1*a* to 1*d* to cause a surface of each of the photosensitive drums 1*a* to 1*d* to be heated up.

According to a configuration of this embodiment, an alternating current bias is applied to a plurality of conductive members (herein, the charging roller 22 and the cleaning roller 27) making contact with each of the photosensitive drums 1*a* to 1*d*, and thus compared with the first embodiment in which an alternating current bias is applied only to the charging roller 22, a heating-up time for heating up the surface of each of the photosensitive drums 1*a* to 1*d* is reduced, so that a user's waiting time can be reduced.

In addition to the above, without being limited to the foregoing embodiments, the present disclosure can be variously modified within the spirit of the present disclosure. For example, while each of the foregoing embodiments describes an example in which, as each of the photosensitive drums 1*a* to 1*d*, an a-Si photosensitive member is used, an exactly similar description can be made also in a case of using an organic photosensitive member or a selenium arsenic photosensitive member.

Furthermore, the present disclosure is not limited to the color printer 100 of an intermediate transfer type shown in FIG. 1 and is applicable to image forming apparatuses of various types such as a color copier and a printer of a direct transfer type, a monochrome copier, a digital multi-function peripheral, and a facsimile. In a case of an apparatus of the direct transfer type, a conductive transfer roller makes contact with a photosensitive drum to form a transfer nip portion. Thus, a heating-up mode can be executed by applying an alternating current bias to the transfer roller.

The present disclosure can be used, in an image forming apparatus using a photosensitive drum as an image bearing member, to remove moisture on a surface of the photosensitive drum. The use of the present disclosure can remove, with high efficiency, moisture on the surface of the photosensitive drum in a short time and thus can provide an image forming apparatus that is capable of effectively preventing the occurrence of image deletion over a long period of time.

What is claimed is:

1. An image forming apparatus, comprising:

an image bearing member that has a photosensitive layer formed on an outer peripheral surface thereof;

a first conductive member that makes contact with the photosensitive layer of the image bearing member;

a bias application device that applies a bias including an alternating current bias to the first conductive member; and a control portion that controls the bias application device, wherein image formation is performed on a surface of the image bearing member while the image bearing member is made to rotate, and the image forming apparatus is capable of executing a heating-up mode in which, at a time of non-image formation, in a state where the image bearing member is made to rotate at a velocity lower than that used at a time of image formation, an alternating current bias having a frequency higher than that used at the time of image formation and a peak-to-peak value twice or more as large as a discharge start voltage between the first conductive member and the image bearing member is applied to the first conductive member to cause a surface of the image bearing member to be heated up.

2. The image forming apparatus according to claim 1, wherein a temperature and humidity detection device that detects a temperature and a humidity inside the image forming apparatus is provided, and the control portion changes, in accordance with a temperature and a humidity that are detected by the temperature and humidity detection device, a frequency of an alternating current bias to be applied to the first conductive member at a time of executing the heating-up mode.

3. The image forming apparatus according to claim 1, wherein in accordance with an energization time that is a duration of energizing the image bearing member since a start of use of the image bearing member, the control portion increases, in stages, a frequency of an alternating current bias to be applied to the first conductive member at a time of executing the heating-up mode.

4. The image forming apparatus according to claim 1, wherein at a time of executing the heating-up mode, an alternating current bias having a frequency in such a range that no discharge occurs between the image bearing member and the first conductive member is applied.

5. The image forming apparatus according to claim 1, wherein the bias application device is capable of applying, to the first conductive member, a bias obtained by superimposing an alternating current bias on a direct current bias, and at a time of executing the heating-up mode, a bias obtained by superimposing a direct current bias not higher than the discharge start voltage between the first conductive member and the image bearing member on the alternating current bias is applied.

6. The image forming apparatus according to claim 5, wherein at the time of executing the heating-up mode, a direct current bias to be applied to the first conductive member is set to 0.

7. The image forming apparatus according to claim 1, wherein the first conductive member is a conductive roller obtained by forming a roller body made of a conductive material having a dielectric property on an outer peripheral surface of a metallic shaft.

8. The image forming apparatus according to claim 1, wherein the image bearing member is contacted further by at least one second conductive member, and the control portion executes the heating-up mode by applying an alternating current bias to the first conductive member and the second conductive member.

9. The image forming apparatus according to claim 8, wherein to the second conductive member of some type, no bias is applied at the time of image formation.

10. The image forming apparatus according to claim 1, wherein the photosensitive layer formed on the outer peripheral surface of the image bearing member is an amorphous silicon photosensitive layer.

11. An image forming apparatus, comprising:

an image bearing member that has a photosensitive layer formed on an outer peripheral surface thereof;

a first conductive member that makes contact with the photosensitive layer of the image bearing member;

a bias application device that applies a bias including an alternating current bias to the first conductive member; and a control portion that controls the bias application device, wherein image formation is performed on a surface of the image bearing member while the image bearing member is made to rotate, and the image forming apparatus is capable of executing a heating-up mode in which, at a time of non-image formation, in a state where the image bearing member is stopped from rotating, an alternating current bias having a peak-to-peak value twice or more as large as a discharge start voltage between the first conductive member and the image bearing member is applied to the first conductive member to cause a surface of the image bearing member to be heated up.

12. The image forming apparatus according to claim 11, wherein at a time of executing the heating-up mode, an alternating current bias having a frequency higher than that used at a time of image formation is applied to the first conductive member.

* * * * *